US008910922B1

(12) United States Patent
Erickson

(10) Patent No.: US 8,910,922 B1
(45) Date of Patent: Dec. 16, 2014

(54) PORTABLE CRANE FOR INSTALLING AND REMOVING WINDOWS

(71) Applicant: Roger D. Erickson, Andover, MN (US)

(72) Inventor: Roger D. Erickson, Andover, MN (US)

( * ) Notice: Subject to any disclaimer, the term of this patent is extended or adjusted under 35 U.S.C. 154(b) by 0 days.

(21) Appl. No.: 13/896,584

(22) Filed: May 17, 2013

(51) Int. Cl.
*B66D 1/36* (2006.01)
*E04G 21/16* (2006.01)
*B66C 23/36* (2006.01)
*B66C 23/46* (2006.01)

(52) U.S. Cl.
CPC ..... *E04G 21/16* (2013.01); *B66C 23/365* (2013.01); *B66C 23/46* (2013.01)
USPC ..... 254/281; 254/285; 254/286; 254/326; 254/327; 254/332; 254/338

(58) Field of Classification Search
USPC ..... 254/278, 279, 280, 281, 284, 285, 286, 254/323, 324, 325, 326, 327, 329, 332, 335, 254/338
See application file for complete search history.

(56) References Cited

U.S. PATENT DOCUMENTS 1,422,459 A * 7/1922 Manley ..... 254/337
1,428,887 A * 9/1922 Hescock ..... 74/25
1,699,587 A * 1/1929 Grenier ..... 212/168
1,861,191 A * 5/1932 Russell ..... 212/294
1,996,458 A * 4/1935 Claney ..... 254/326
2,372,311 A * 3/1945 Brown ..... 414/690
2,509,435 A * 5/1950 Huttinger ..... 254/326
2,822,931 A * 2/1958 Sparrow ..... 414/495
2,892,555 A * 6/1959 Hooker ..... 414/543
3,322,396 A * 5/1967 Hubbard ..... 414/539
3,578,290 A * 5/1971 Gof ..... 254/326
3,825,132 A * 7/1974 Colangelo ..... 414/563
3,843,093 A * 10/1974 Thompson et al. ..... 254/325
3,939,988 A * 2/1976 Wellman ..... 212/297
4,050,587 A * 9/1977 Moen ..... 212/301
4,068,827 A * 1/1978 Fanning et al. ..... 254/325
4,103,799 A * 8/1978 Perez ..... 414/563
4,383,807 A * 5/1983 Bubik ..... 414/563
4,616,225 A * 10/1986 Woudenberg ..... 340/908
4,934,659 A * 6/1990 Yoke ..... 254/326
5,975,826 A * 11/1999 Scholder ..... 414/444
6,193,218 B1 * 2/2001 Philyaw ..... 254/326
6,234,453 B1 * 5/2001 Block ..... 254/285
6,371,449 B1 * 4/2002 Chamberlain ..... 254/387
6,601,825 B2 * 8/2003 Bressner et al. ..... 254/4 R
7,500,651 B2 * 3/2009 Wentworth et al. ..... 254/323
7,845,622 B1 * 12/2010 Riggs ..... 254/326
2009/0277857 A1 * 11/2009 Rice ..... 212/302
2010/0072442 A1 * 3/2010 Bolton ..... 254/325
2010/0295005 A1 * 11/2010 Riggs ..... 254/326

* cited by examiner

*Primary Examiner* — Emmanuel M Marcelo
(74) *Attorney, Agent, or Firm* — Dave Alan Lingbeck

(57) ABSTRACT

A portable crane for installing and removing windows. The portable crane for installing and removing windows includes a wheeled base with a platform having front and rear ends; a boom support assembly removably fastened to the wheeled base; and a boom assembly supported by the boom support assembly.

11 Claims, 4 Drawing Sheets

PORTABLE CRANE FOR INSTALLING AND REMOVING WINDOWS

BACKGROUND OF THE INVENTION

1. Field of the Invention

The present invention relates to cranes and more particularly pertains to a new portable crane for installing and removing windows.

2. Description of the Prior Art

The use of cranes is known in the prior art. More specifically, cranes heretofore devised and utilized are known to consist basically of familiar, expected and obvious structural configurations, notwithstanding the myriad of designs encompassed by the crowded prior art which have been developed for the fulfillment of countless objectives and requirements.

The prior art describes a portable crane having an elongated boom which attaches at one en to a lower end of a base frame member wherein the upper end of the boom has a stabilizer member attached thereto which stabilizer attached to the upper end of the base frame member. The base frame member is pivotally attached using removable clamps to an upstanding member, for example, a door frame. Another prior art describes a convertible lifting device including a base. A vertical stanchion is coupled with respect to the base. A horizontal stanchion is pivotally coupled with respect to the vertical stanchion. The horizontal stanchion includes a hook disposed on an outer end thereof. A hydraulic ram is coupled between the vertical stanchion and the horizontal stanchion, A hydraulic pump is coupled with the vertical stanchion in communication with the hydraulic ram. Yet, another prior art describes a lifting apparatus including a beam assembly, a lifter affixed to a surface of the beam assembly for lifting weighted objects toward or away from the beam assembly, a cable extending from the lifter, a first leg pivotally connected to one side of the lifter on the beam assembly and a second leg pivotally connected to an opposite side of the lifter on the beam assembly.

While these devices fulfill their respective, particular objectives and requirements, the aforementioned patents do not disclose a new portable crane for installing and removing windows.

SUMMARY OF THE INVENTION

The general purpose of the present invention, which will be described subsequently in greater detail, is to provide a new portable crane for installing and removing windows which has many of the advantages of the cranes mentioned heretofore and many novel features that result in a new portable crane for installing and removing windows which is not anticipated, rendered obvious, suggested, or even implied by any of the prior art cranes, either alone or in any combination thereof. The present invention includes a wheeled base with a platform having front and rear ends; a boom support assembly removably fastened to the wheeled base; and a boom assembly supported by the boom support assembly. None of the prior art includes the combination of the elements of the present invention.

There has thus been outlined, rather broadly, the more important features of the portable crane for installing and removing windows in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable crane for installing and removing windows which has many of the advantages of the cranes mentioned heretofore and many novel features that result in a new portable crane for installing and removing windows which is not anticipated, rendered obvious, suggested, or even implied by any of the prior art cranes, either alone or in any combination thereof Still another object of the present invention is to provide a new portable crane for installing and removing windows.

Still yet another object of the present invention is to provide a new portable crane for installing and removing windows that is collapsible and easy to set up in very confined spaces.

Even still another object of the present invention is to provide a new portable crane for installing and removing windows that allows one person to install and remove windows and also prevents someone from getting severely injured and prevents windows from being damaged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
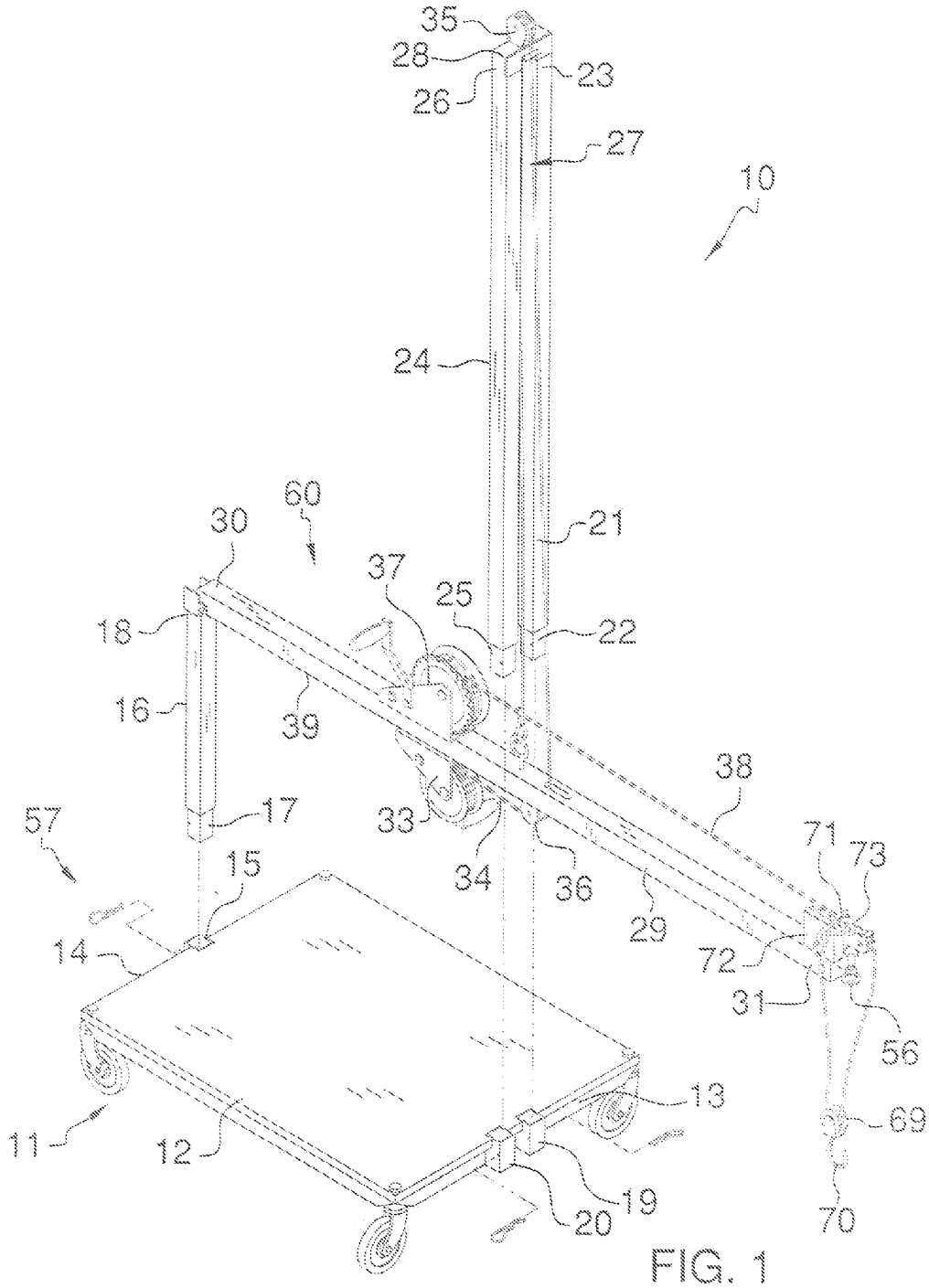
FIG. 1 is an exploded perspective view of a new portable crane for installing and removing windows according to the present invention.

With reference now to the drawings, and in particular to FIGS. 1 through 4 thereof, a new portable crane for installing and removing windows embodying the principles and concepts of the present invention and generally designated by the reference numeral 10 will be described.

As best illustrated in FIGS. 1 through 4, the portable crane 10 for installing and removing windows generally comprises a wheeled base 11 with a platform 12 having front and rear ends 13,14 and having wheels conventionally fastened to a bottom of the platform 12 and also adapted to support weighted members upon the platform 12 to prevent the wheeled base 11 from tipping over during the use thereof. The portable crane 10 also comprises a boom support assembly 57 removably and conventionally fastened to the wheeled base 11 and further comprises a boom assembly 60 conventionally supported by the boom support assembly 57.

Figure 2:
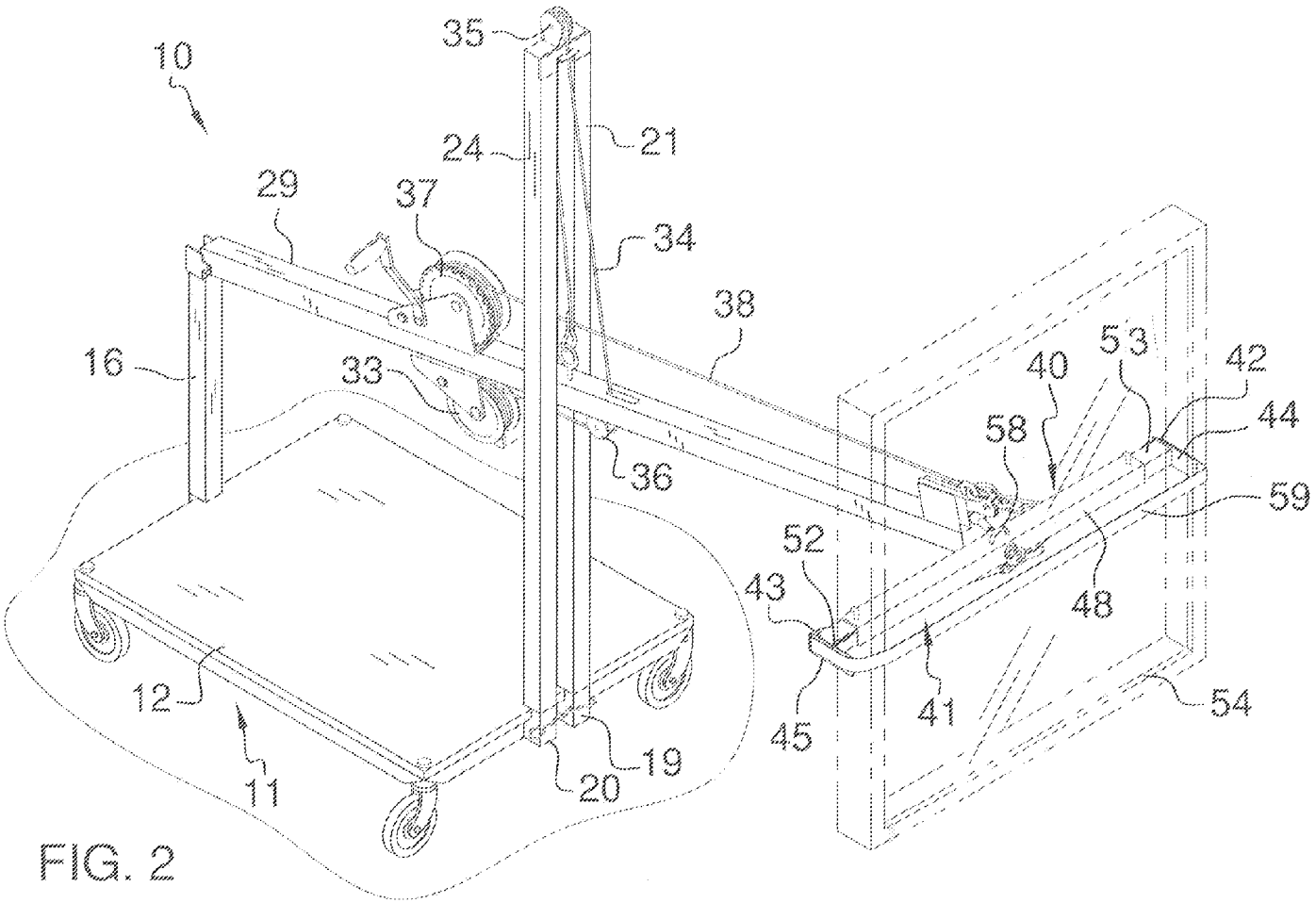
FIG. 2 is a front perspective view of the present invention with a window being lifted for installation.
Figure 3:
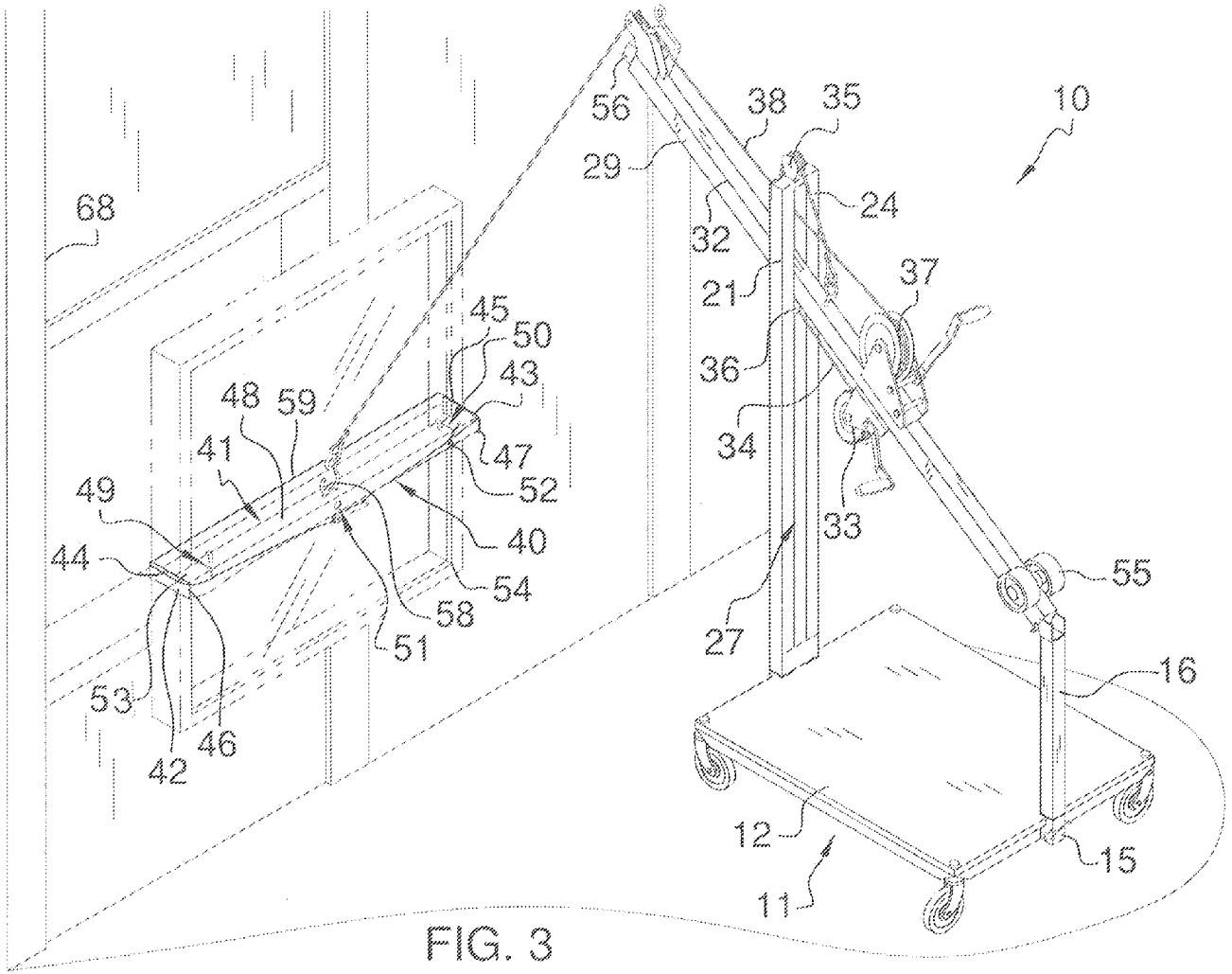
FIG. 3 is a rear perspective view of another embodiment of the present invention with the boom being lowered in order to lift the window.

As illustrated in FIGS. 2 and 3, the boom support assembly 57 may include an elongate support member 16 being that of a tube made of rigid material and having a selected length. The elongate support member 16 may have a bottom end 17 removably and conventionally fastened to the wheeled base 11 and may have a top end 18. The elongate support member 16 may extend upwardly from and perpendicularly to the platform 12. The boom support assembly 57 further may include a first receiver 15 being that of a socket made of rigid material and conventionally fastened at a back end 14 and along an edge of the platform 12 with the bottom end 17 of the elongate support member 16 removably received and conventionally fastened in and to the first receiver 15.

As shown in FIGS. 2 and 3, the boom support assembly 57 further may include elongate guide members 21,24 each being that of an elongate tube made of rigid material and having a bottom end 22,25 removably and conventionally fastened to the wheeled base 11 with the elongate guide members 21,24 extending upwardly from and perpendicularly to the platform 12. The boom support assembly 57 also may include second and third receivers 19,20 being that of sockets and made of rigid material and conventionally fastened to a front end 13 and along an edge of the platform 12 with the bottom ends 22,25 of the elongate guide members 21,24 removably received and conventionally fastened in and to the respective second and third receivers 19,20. The elongate guide members 21,24 may be disposed parallel to each other and may be arranged to form a space 27 therebetween with the elongate guide members 21,24 having lengths longer than that of the elongate support member 16. The boom support assembly 57 may further include a cross member 28 conventionally interconnecting the elongate guide members at top ends 23,26 thereof for substantially stabilizing the elongate guide members 21,24.

As illustrated in FIGS. 2 and 3, the boom assembly 60 may include an elongate boom 29 made of rigid material and having a back end 30 pivotally and conventionally attached to the top end 18 of the elongate support member 16. The elongate boom 29 also may have a front end 31 and a front end portion 32 extending through the space 27 between the elongate guide members 21,24 to prevent the elongate boom 29 from swaying side to side with the elongate boom 29 extending forward of the platform 12 and with the front end portion 32 of the elongate boom 29 suspended from the elongate guide members 21,24. The front end portion 32 may be movable up and down relative to the platform 12 to raise and lower a window 54. The boom assembly 60 further may include a first winch 33 for raising and lowering the front end portion 32 of the elongate boom 29 and pivoting the back end 30 of the elongate boom 29 upon the elongate support member 16. The first winch 33 may be conventionally mounted to the front end portion 32 of the elongate boom 29 so that a user can operate the first winch 33 and also grasp and maneuver the window 54 concurrently without needing additional manpower, and also includes a first cable 34 being carried by the first winch 33 and being conventionally coupled to a grommet which is conventionally fastened to the elongate boom 29 for raising and lowering the front end portion 32 of the elongate boom 29. The boom assembly 60 may also include a first pulley 35 conventionally attached to the cross member 28 and further may include a second pulley 36 conventionally attached to the first end portion 32 of the elongate boom 29 with the first cable 34 being carried by the first and second pulleys 35,36. The boom assembly 60 also may include a second winch 37 for lifting and moving an object. The second winch 37 may be conventionally mounted to the elongate boom 29 and further may include a second cable 38 carried by the second winch 37 and a third pulley conventionally attached at the front end 31 of the elongate boom 29 for facilitating the lifting and moving of the object. The first winch 33 may be conventionally coupled to a bottom side 39 of the elongate boom 29 beneath the second winch 37 so that the user can raise and lower the elongate boom 29 and also grasp and maneuver the window 54 concurrently. As illustrated in FIG. 1, another embodiment of the boom assembly 60 may include a cable support member 72 being conventionally attached at the front end 31 of the elongate boom 29, and further includes a ring 73 being conventionally attached to the cable support member 72, and also includes a pulley block 69 carrying the second cable 38 with a first hook 70 conventionally depending from the pulley block 69, and further includes a second hook 71 being conventionally connected to an end of the second cable 38 and being connectable to the ring 73.

As illustrated in FIG. 3 and as yet another embodiment, the boom assembly 60 may further include wheels 55 being conventionally attached or bolted proximate to a back end 30 of the elongate boom 29 such that when the elongate boom 29 and the elongate support member 16 are removed from the platform 12 so that the portable crane 10 can be more easily moved, the user can roll the elongate boom 29 and the elongate support member 16 upon the wheels 55 on a ground. The boom assembly 60 may also include a pivot member 56 conventionally attached to and extending from the front end 31 of the elongate boom 29 and also having a stub length. The boom assembly 60 further may include a support bar assembly 40 which includes an elongate tubular member 48 made of any suitable material and having opposed open ends 49,50 and further may include an opening 51 centrally disposed therein. A pair of bars 52,53 may be movably disposed in the elongate tubular member 48 through the open ends 49,50 thereof with fasteners being threaded through bosses and holes in the elongate tubular member 48 and being engagable to the bars 52,53 to secure the bars 52,53 to the elongate tubular member 48 with the length of the combination of the bars 52,53 and the elongate tubular member 48 being set.

Also, as shown in FIGS. 2 and 3, the elongate tubular member 48 and the bars 52,53 in combination may form an adjustable support bar 41 adapted to engage the window 54 with the pivot member 56 being receivable in the opening 51 to pivotably support the support bar assembly 40. The support bar assembly 40 further includes an eyelet 58 conventionally attached to a top side of the adjustable support bar 41, and may also include fingers 44,45 conventionally attached to and disposed at ends 42,43 of the adjustable support bar 41 and disposed perpendicular to a longitudinal axis of the adjustable support bar 41 and each terminating in a ring 46,47 at an end thereof. The support bar assembly 40 may also include an adjustable strap 59 being disposed through the rings 46,47 and being adapted to engage about the window 54 with the second cable 38 being conventionally connectable to the eyelet 58. The boom assembly 60 may also include a conventional ratchet member being conventionally connected to the strap 59 to adjust the length of the strap 59 and to tighten and secure the strap 59 about the window 54.

Figure 4:
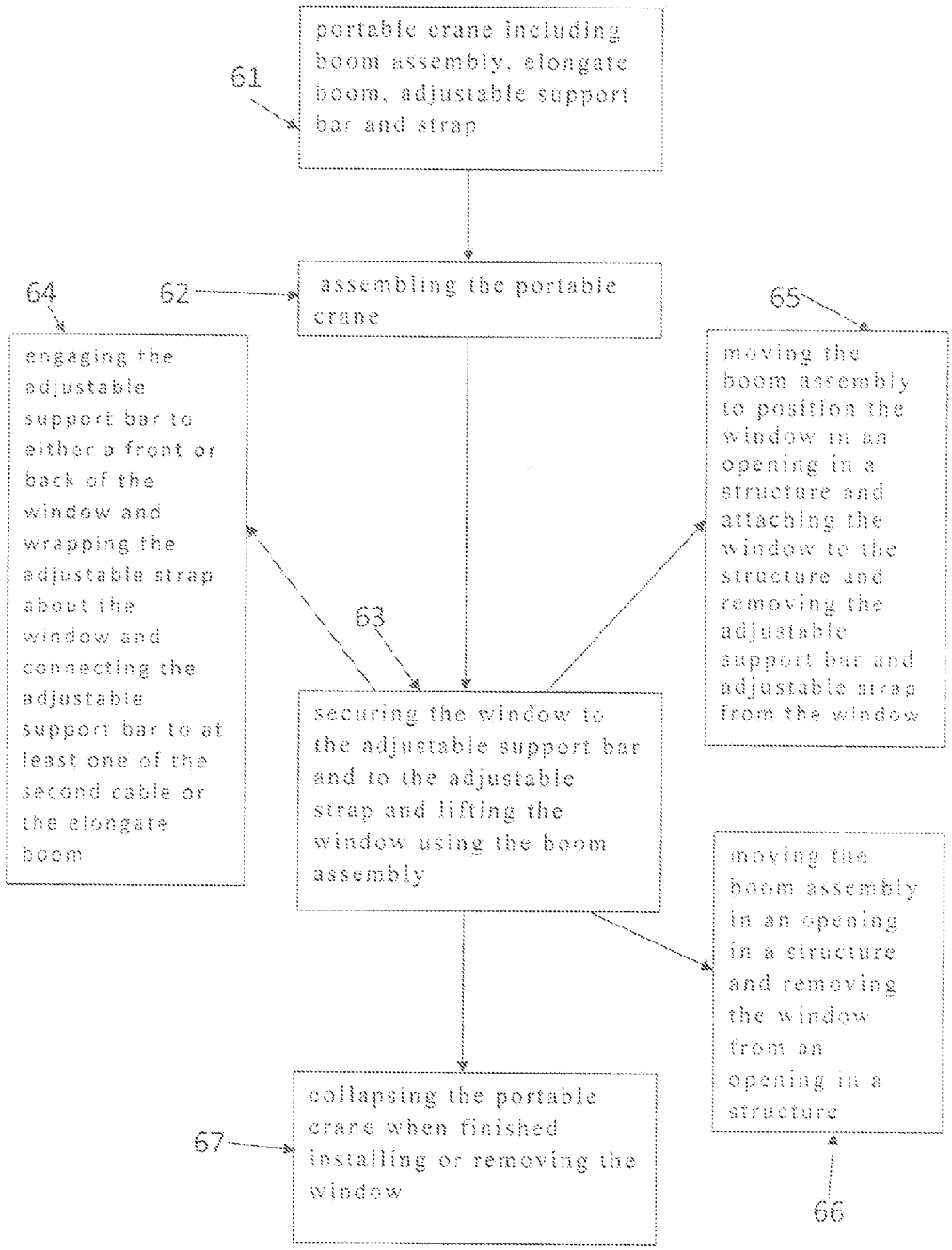
FIG. 4 is a flow chart of installing/removing a window according to the present invention.

As shown in FIG. 4, the user can easily assemble the portable crane 10 (Block 61) at a site where a window 54 is being installed or removed by fastening the elongate support member 16 and the elongate guide members 21,24 to the platform 12 and then pivotally fastening the elongate boom 29 to the elongate support member 16 and suspending the front end portion 32 of the elongate boom 29 with the first cable 34 from the elongate guide members 21,24. (Block 62) The user then engages the adjustable support bar 41 to either a front or back side of the window 54 and either conventionally attaches the support bar 41 so the second cable 38 or pivotably mounts the support bar 41 upon the pivot member 56 and then wraps and secures the strap 59 about the window 54. (Block 63) The second winch 37 is used to lift the window 54 so that the user can maneuver the window 54 by either positioning the window 54 in the opening of the structure 68 (block 64,65) or removing the window 54 from the opening in the structure. (Block 66) Once finished, the user can easily collapse the portable crane 10 by unfastening and removing the elongate support member 16 and the elongate guide members 21,24 from the platform 12. (Block 67)

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable crane for installing and removing windows. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable crane for installing and removing windows comprising:

a wheeled base with a platform having front and rear ends;

a boom support assembly removably fastened to the wheeled base, wherein the boom support assembly includes an elongate support member having a bottom end removably fastened to the wheeled base and having a top end, the elongate support member extending upwardly from the platform, wherein the boom support assembly further includes elongate guide members each having a bottom end removably fastened to the wheeled base with the elongate guide members extending upwardly from the platform, wherein the elongate guide members are disposed parallel to each other and are arranged to form a space therebetween; and a boom assembly supported by the boom support assembly, wherein the boom assembly includes an elongate boom having a back end pivotally attached to the top end of the elongate support member.

2. The portable crane for installing and removing windows as described in claim 1, wherein the elongate boom also has a front end and a front end portion extending through the space between the elongate guide members and suspended from the elongate guide members to prevent the elongate boom from swaying side to side, the front end portion being movable up and down relative to the platform to raise and lower a window.

3. The portable crane for installing and removing windows as described in claim 2, wherein the boom assembly further includes a first winch for raising and lowering the front end portion of the elongate boom and pivoting the back end of the elongate boom upon the elongate support member, wherein the first winch is mounted to the front end portion of the elongate boom so that a user can operate the first winch and grasp and maneuver the window concurrently, and also includes a first cable carried by the first winch and coupled to the elongate boom for raising and lowering the front end portion of the elongate boom.

4. The portable crane for installing and removing windows as described in claim 3, wherein the boom support assembly further includes a cross member interconnecting the elongate guide members.

5. The portable crane for installing and removing windows as described in claim 4, wherein the boom assembly also includes a first pulley attached to the cross member and further includes a second pulley attached to the first end portion of the elongate boom with the first cable carried by the first and second pulleys.

6. The portable crane for installing and removing windows as described in claim 3, wherein the boom assembly also includes a second winch for lifting and moving an object, wherein the second winch is mounted to the elongate boom and further includes a second cable carried by the second winch for facilitating the lifting and moving of the object.

7. The portable crane for installing and removing windows as described in claim 6, wherein the first winch is coupled to a bottom side of the elongate boom beneath the second winch so that the user can raise and lower the elongate boom and also grasp and maneuver the window.

8. The portable crane for installing and removing windows as described in claim 6, wherein the boom assembly also includes a cable support member being attached at the front end of the elongate boom, and further includes a ring being attached to the cable support member, and also includes a pulley block carrying the second cable with a first hook depending from the pulley block, and further includes a second hook being connected to an end of the second cable and being connectable to the ring.

9. The portable crane for installing and removing windows as described in claim 6, wherein the boom assembly further includes a pivot member attached to and extending from the front end of the elongate boom and also includes wheels being attached proximate to the back end of the elongate boom to easily transport the portable crane.

10. The portable crane for installing and removing windows as described in claim 9, wherein the boom assembly further includes a support bar assembly including an elongate tubular member having at least one open end, and an opening disposed therein, and also including at least one bar movably disposed in the elongate tubular member through the at least one open end thereof, the elongate tubular member and the at least one bar in combination forming an adjustable support bar adapted to engage a window, the pivot member being receivable in the opening to pivotably support the support bar assembly.

11. The portable crane for installing and removing windows as described in claim 10, wherein the support bar assembly further includes an eyelet attached to the adjustable support bar, and also includes fingers disposed at ends of the adjustable support bar and disposed perpendicular to a longitudinal axis of the adjustable support bar and each terminating in a ring, the support bar assembly also including an adjustable strap being disposed through the rings and being adapted to engage about the window, the second cable being connectable to the eyelet.

* * * * *